US005150971A

United States Patent [19]

Strong et al.

[11] Patent Number: 5,150,971

[45] Date of Patent: Sep. 29, 1992

[54] DIAGNOSTIC SPECIMEN MAILING DEVICE

[75] Inventors: Kathleen M. Strong, Sunnyvale; Richard S. Matusewicz, San Jose, both of

[73] Assignee: Beckman Instruments, Inc., Fullerton, Calif.

[21] Appl. No.: 813,065

[22] Filed: Dec. 23, 1991

Related U.S. Application Data

[63] Continuation of Ser. No. 622,677, Dec. 7, 1990, abandoned.

[51] Int. Cl.[5] ..... B65D 30/08; B65D 33/18

[52] U.S. Cl. ..... 383/84; 229/80; 383/113

[58] Field of Search ..... 383/84, 5, 113; 229/80, 229/82

[56] References Cited

U.S. PATENT DOCUMENTS

| | | | |
|---|---|---|---|
| 3,915,806 | 10/1975 | Horlach . | |
| 4,309,782 | 1/1982 | Paulin . | |
| 4,387,126 | 6/1983 | Rebholz | 383/113 |
| 4,580,683 | 4/1986 | Gochenour | 383/84 |
| 4,895,297 | 1/1990 | Klamm | 229/69 |
| 4,948,018 | 8/1990 | Vollowitz | 229/80 |

FOREIGN PATENT DOCUMENTS

| | | | |
|---|---|---|---|
| 1479966 | 5/1967 | France | 229/80 |
| 1505539 | 12/1967 | France | 229/80 |
| 10324 | of 1905 | United Kingdom | 229/80 |
| 1470786 | 4/1977 | United Kingdom | 383/84 |

OTHER PUBLICATIONS

SmithKline Diagnostics, Inc. Specimen Mailing Pouch

Seracult ® Specimen Mailing Pouch.

*Primary Examiner*—Stephen P. Garbe

*Attorney, Agent, or Firm*—William H. May; Arnold Grant; Richard P. Burgoon, Jr.

[57] ABSTRACT

A mailing device for etiologic agents and/or biomedical materials is disclosed. The mailing device comprises a front panel joined to a back panel, the back panel being longer than the front panel. Three sides of each panel are sealed together, preferably by an adhesive, most preferably by heat sealing, such that an opening to an internal region is created, said opening defined by the top, unsealed portion of the front panel, and the top unsealed portion of the back panel which exceeds the height of the front panel. The region of the back panel extending above that of the front panel is referred to as a "flap" or "flap region". The flap region includes means for folding the flap along a substantially parallel line to said opening, said line being located above the opening, preferably from between about one-fourth to about one-half of the distance of the flap upwards from said opening and most preferably about one-fourth of the distance of said flap upward from said opening. The flap of the device further includes at least one tab extending outwardly therefrom such that when the flap is folded and sealed, the tab can similarly be folded and sealed to either the front panel or the back panel so as to provide an added measure of security.

10 Claims, 2 Drawing Sheets

DIAGNOSTIC SPECIMEN MAILING DEVICE

This is a continuation of application Ser. No. 07/622,677, filed Dec. 7, 1990, now abandoned.

FIELD OF THE INVENTION

The present invention is related to mailing envelopes and more particularly to mailing envelopes for diagnostic specimens.

BACKGROUND OF THE INVENTION

The advent of patient-friendly specimen collection test devices has allowed patients to obtain certain etiologic agents and/or biomedical materials (such as, for example, fecal specimens) in the privacy of the patient's home, advantageously avoiding embarrassment, discomfort and anxiety for not only the patient, but those in the medical profession that require such specimens for analysis. For example, fecal occult blood screening for an indication of the possibility of colon cancer necessitates examination of a fecal specimen from the patient—several test devices are available that allow the patient to incorporate a fecal specimen onto the device such that analysis thereof can be performed at a later time by a healthcare professional.

One problem associated with such devices, however, is that despite the ability to utilize these in a non-medical facility (for example, the patient's home), the patient is usually required to make a special trip to return the device to the healthcare professional for testing thereof. Because the test device can be used, e.g., in the privacy of the patient's home and must be returned to a healthcare professional, it is evident that delivery of the test device via the services of a postal carrier service, for example, the United States Postal Service, would make the return of the test device more convenient for the patient.

Governmental regulations may, and often do, restrict the mailing of etiologic agents and/or biomedical materials due to the potential harm from spills and leakages of such materials. In the United States of America, strict regulations are set forth for the mailing of such specimens. See, 39 C.F.R., Federal Register, Part 111, Vol. 54, No. 156 (Aug. 1989) which is incorporated herein by reference. Aside from such hazardous concerns, certain aesthetic concerns are of similar import, such as, for example, negative odors that may offend those who are required to transport such materials through the mails. Furthermore, because such a mailing device necessarily transports specimens for diagnostic evaluation, it is also essential that the mailing device prevent contaminants from outside the mailing device from contacting the specimen included therein.

Given the routine nature of use of the types of such specimen devices described above, the costs associated with a specimen mailing device can not be prohibitively expensive such that the cost of such a mailing device would outweigh the above noted benefits. Traditional mailing devices are relatively inexpensive. However, such devices include an opening to be sealed by folding a flap along the opening itself—this type of folding can allow for leakage of the contents of the device from the corners of the insertion region. Such a device is in complete contradistinction to the needs of a specimen mailing device that mandates prevention of even the possibility of such leakage.

Accordingly, a need exists for a mailing device for etiologic agents and/or biomedical materials that takes into account not only governmental regulations, but also the sensibilities of those that must handle and process such a device as well as the cost relevant factors noted above. Finally, and because such a device will necessarily find applicability across a broad spectrum of patients, it is important for such a device to be easily manipulated when used.

SUMMARY OF THE INVENTION

A mailing device that complies with and satisfies the above-listed requirements and concerns is disclosed herein.

In an embodiment, the mailing device comprises a front panel joined to a back panel, the back panel being longer than the front panel. Three sides of each panel are sealed together, preferably by an adhesive, most preferably by heat sealing, such that an opening to an internal region is created, the opening defined by the top, unsealed portion of the front panel, and the top unsealed portion of the back panel. Additionally, the height of the back panel exceeds the height of the front panel. The region of the back panel extending above that of the front panel is referred to herein as a "flap" or "flap region". The flap region includes means for folding the flap along a substantially parallel line to said opening, the line being located above the opening, preferably from between about one-fourth to about one-half of the distance of the flap upwards from the opening and most preferably about one-fourth of the distance of the flap upwards from said opening. In this manner, and because the flap is not folded along the pouch opening, leakage out from or into the pouch is avoided. The flap of the device further includes at least one tab, preferably two, extending outwardly from the flap that when the flap is folded and sealed, the tab can similarly be folded and sealed to provide an added measure of security.

Other advantages of the present invention will be made apparent as the description proceeds.

DETAILED DESCRIPTION OF PREFERRED EMBODIMENTS

Figure 1:
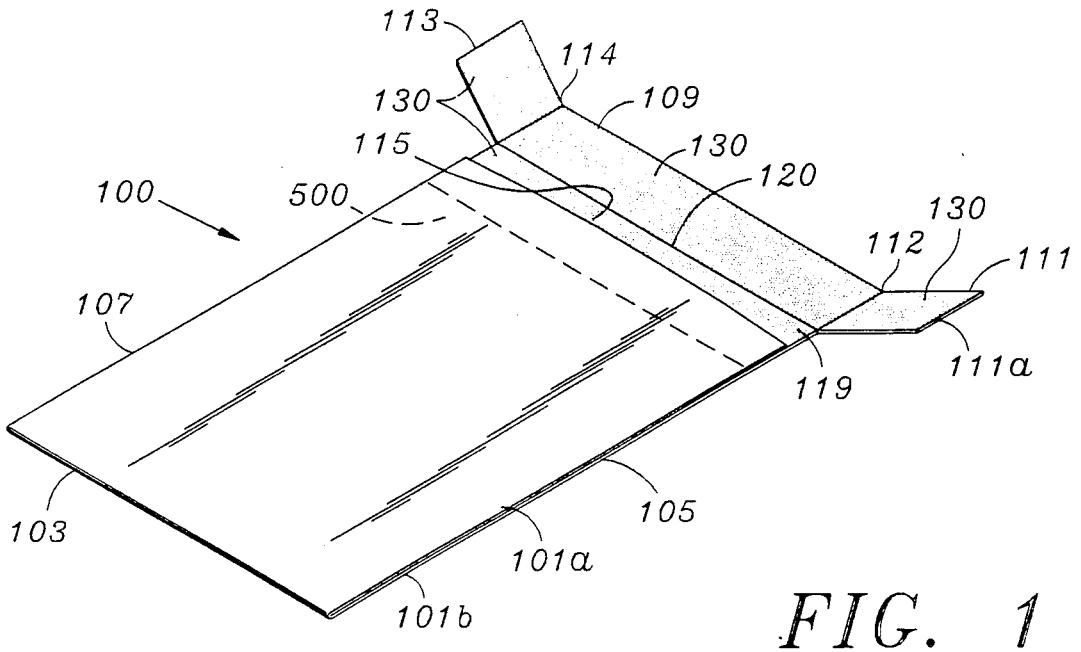
FIG. 1 is a perspective view of an embodiment of the mailing device of the present application, in an open position.
Figure 2:
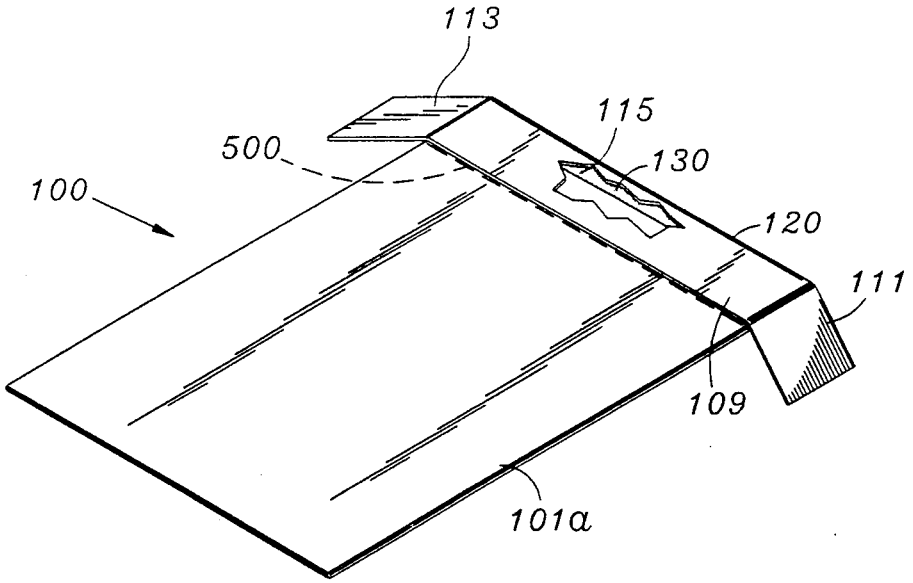
FIG. 2 is the same perspective view of the device of FIG. 1 with the flap sealed.
Figure 3:
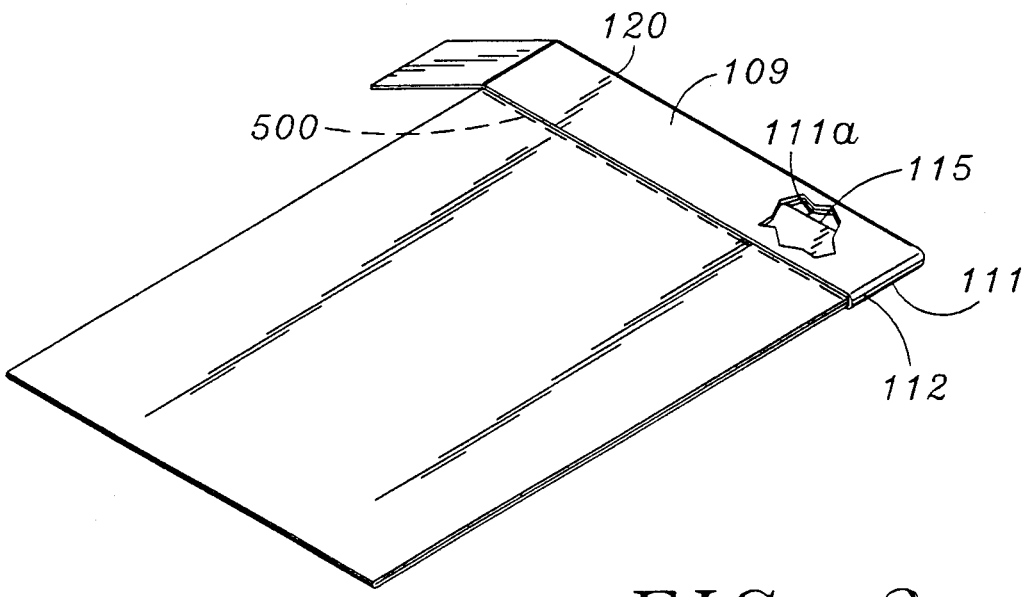
FIG. 3 is the same perspective view of the device of FIG. 2 having one of the two tabs sealed.

With reference to FIG. 1–3 of the preferred embodiment of the invention and where identical numbers designate identical features, a specimen mailing device 100 is depicted. The device is preferably formed of a single sheet, having front panel 101*a* and back panel 101*b* folded along crease 103 where sides 105 and 107 are securely sealed by any suitable sealing method, such as by an adhesive, glue, or, preferably in the disclosed embodiment, heat sealing. A single sheet is preferred in that sealing along crease 103 would not be essential; however, two separate sheets may be utilized, whereby a side corresponding to crease 103 would be sealed in a manner analogous to that used in the sealing of sides 105 and 107.

Referring now to the region of device 100 opposite to crease 103, test device insertion region 115 is defined by the termination of front panel 101*a* and the continuation of back panel 101*b*, whereby a pocket or pouch region is formed, generally being defined as the entire interior region between sides 105, 107, crease 103 and insertion region 115. A flap 109 is defined by the extension of back panel 101*b* from insertion region 115 to the termination of back panel 101*b*, and includes means for indicating the closing off and sealing of insertion region 115. As an example of a means for indicating, crease 120, located about one-fourth of the distance of flap 109 upwards from insertion region 115, defines the area of flap 109 that is folded to secure an etiologic agent and/or biomedical material (not shown) which has been inserted into the pouch region of mailing device 100. Alternative means for indicating the closing off and sealing insertion region 115 include, for example, instructions informing the user to fold flap 109 at a point above insertion region 115, or hash-mark indicators located at about one-fourth to about one-half of the distance upwards from insertion region 115 and most preferably beginning at about one fourth the distance upwards from insertion region 115.

FIG. 2 shows device 100 having flap 109 folded along crease 120 and in secure contact with the upper region of side 101*a*. As best viewed in FIG. 2, by folding flap 109 along crease region 120, specimen device insertion region 115 (shown from a cut-away of flap 109) is advantageously located below crease 120 and above a reference line 500 (shown in phantom) where flap 109 and front panel 101*a* are approximately joined. This folding configuration negates the risk of leakage out from or into region 115 in that region 115 is covered and sealed. Such sealing is preferably effectuated by incorporation of an adhesive 130 on flap 109 and a region 119 between the termination of front panel 101*a* and crease region 120. Thus, when flap 109 is closed, adhesive 130 secures flap 109 to both region 119 and from reference line 500 up to insertion region 115. As an alternative to the use of an adhesive, sealing materials, such as, for example, an adhesive tape, can be applied to flap 109 when it is in its closed position so that sealing thereof to front panel 101*a* is similarly effectuated.

Device 100 further includes tabs 111 and 113 extending outwardly from flap 109 in a direction perpendicular to flap 109. Tabs 111 and 113 include means for folding these so as to engage the exterior region of side 101*b* (not shown). Most preferably, such means for folding are pre-formed creases as defined by lines 112 and 114, respectively. Tabs 111 and 113 also preferably include thereon adhesive 130. Referencing FIG. 3, when flap 109 is folded along crease 120 to a closed position, both tabs are folded inwardly to contact the exterior region of side 101*b* (not shown). FIG. 3 shows tab 111 in a closed position, folded along crease 112, with the outer edge 111*a* (shown in cut-away) of tab 111 perpendicular to crease 120. The cut-away of FIG. 3 also shows insertion region 115 approximately bisecting tab 111. Thus, when both flap 109 and tabs 111 and 113 are in a closed position, insertion region 115 is completely sealed such that leakage from within is prevented, and contamination from outside influence is also prevented.

Figure 4:
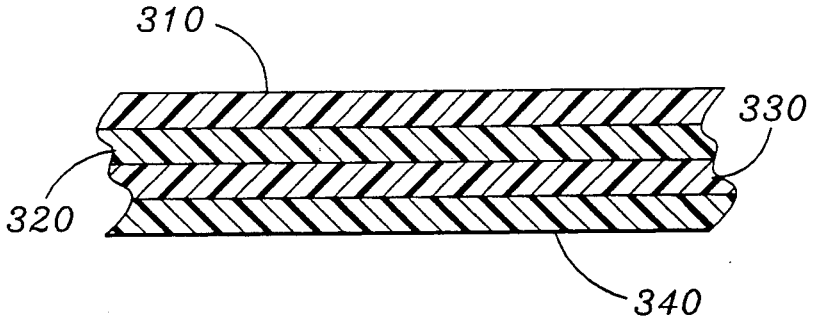
FIG. 4 is a side view of an embodiment of the mailing device of the present application including an additional interior barrier.

Preferably, device 100 is die cut from a single sheet so that flap 109, tabs 111 and 113, crease 120, and creases 112 and 114 are formed during the die-cutting process. As best viewed in FIG. 4 the single sheet includes at least three layers: a first layer 310 (i.e. the outer layer) can be paper or cardboard; a second layer 320 (i.e. the middle layer) can be a metallic foil or metallized polymeric material; and a third layer 330 (i.e. the interior layer) can be a thin layer of polyethylene or polypropylene laminated thereon to seal the second layer to the first. Three layers are preferred because the middle layer, which can be sealed to the outer layer by the interior layer, acts as a "primary barrier" against leakage of the etiological and/or biomedical materials through the outer layer if such material begins to leak from the pouch region. Accordingly, metallic foils (such as aluminum) and metallized polymeric materials are most preferred for the middle layer because such materials prevent such leakage. Paper or cardboard materials are most preferred for the outer layer in that these can be readily pre-printed with information typically imprinted on mailing envelopes (i.e. postage stamp location, return address information, as well as any pertinent instructions). Polyethylene and polypropylene are most preferred for the third layer in that these materials are useful in a heat-sealing process because these materials, by their very nature, will form a sealed bond upon heating.

A layer of adhesive 130, as previously detailed, is preferably added onto the third layer and can begin directly above insertion region 115, covering flap 109, tabs 111 and 113 and region 119. A removable protective tape (not shown) is preferably included on the adhesive 130. When completed, the mailing device can have mailing information printed on sides 101*a* or 101*b*, as well as any other pertinent and/or additional information.

An additional layer or barrier 340 can be layered on top of the third layer such that when the device is fully constructed, the interior region between sides 105, 107, crease 103 and insertion region 115 (FIG. 1-3) is defined between layer 340. Layer 340 can be either a single sheet such that the single sheet is folded when crease 103 is formed, or two sheets. In either case, when sides 105 and 107 are sealed, layer 340 is similarly sealed. Thus, layer 340 forms a "pocket" within the embodiment disclosed in FIG. 1-3. Layer 340 is preferably a flexible material that is liquid impermeable; layer 340 is primarily intended to act as additional security against any potential leakage from an etiologic agent and/or biomedical material inserted into the device. Flexibility is preferred for the additional barrier primarily for manufacturing concerns in that if the additional barrier is too thick (i.e. not flexible), manipulation of the device during the manufacturing process is made unnecessarily difficult. Layer 340 can be sealed to the interior layer by either an adhesive joining layer 340 to the interior layer, or by heat sealing in a manner previously described. Because layer 340 is preferably flexible and water impermeable, it can be selected from a group consisting of polyvinyl chlorides, polyesters, polycarbonates, polyethylene, and multi-polymeric materials, such as, for example, paper coated with any of the above listed materials. Most preferably, the thickness of layer 340 is between about 2 and about 15 mils (1 mil=0.001 inch). Such a thickness range is most preferred because it provides sufficient flexibility for layer 340.

To use the device, a specimen collection device including an etiologic agent and/or biomedical material is inserted into the interior portion of mailing device 100 at insertion region 115. A protective tape (not shown) covering adhesive 130 is removed, and flap 109 is folded along crease 120 such that flap 109 securely seals insertion region 115. Thereafter, tabs 111 and 113 are folded along creases 112 and 114, respectively, such that when completed, tabs 111 and 113 are in contact with the exterior portion of side 101*b* (not shown). Mailing of the device is then accomplished in a manner as defined by the rules and requirements for utilization of the applicable postal service. When received by the healthcare professional, the test device can be removed by cutting or tearing open the mailing device along any edge.

While the foregoing mailing device has been described in considerable detail and in terms of preferred embodiments, these are not to be construed as limitations on the disclosure or the claims that follow. Modifications and changes that are within the purview of those skilled in the art are intended to fall within the scope of the following claims.

What is claimed is:

1. A mailing device useful for etiologic agents and biomedical materials comprising:

a) a substantially rectangular front panel and a substantially rectangular back panel where three sides of said front panel and three sides of said back panel are in sealed communication with each other, said sealed sides being impervious to liquids, and where a fourth side of said front panel and a fourth side of said back panel define an opening to an interior central region between said front panel and said back panel, said front panel and said back panel each comprising at least two layers, a first outer layer and a second interior layer, said second interior layer being exposed to said interior central region, said second interior layer being impervious to liquids, said second interior layer being chemically inert to etiologic agents and biomedical materials, the side of said back panel not in sealed communication with the side of said front panel further comprising a flap region, said flap region defining a first length, said flap region comprising:

i) adhesive means for sealing said flap region to said front panel;

ii) means for folding said flap region, said means being located along a line substantially parallel to said opening to said interior central region, said line being from about one-fourth to about one-half of the length of said flap region from said opening to said interior central region; and iii) at least two tabs, a first tab extending outwardly from said flap region in a direction parallel to the opening of said interior central region, and a second tab extending outwardly from said flap region in a direction parallel to the opening of said interior central region, said first tab and said second tab being on opposite ends of said flap region relative to each other, said first tab and said second tab each including means for folding said tabs, said first tab and said second tab each including adhesive means for sealing said tabs to said back panel.

2. The device of claim 1 wherein said means for folding said tabs is a crease in each tab.

3. The device of claim 1 wherein said first outer layer is a material chosen from the group consisting of paper and cardboard.

4. The device of claim 1 wherein said second, interior layer is a material chosen from the group consisting of polyethylenes and polypropylenes.

5. The device of claim 1 wherein said front and back panels each further comprise a third middle layer between said first outer layer and said second interior layer.

6. The device of claim 5 wherein said third middle layer is a material chosen from the group consisting of metallic foils and metallized polymeric materials.

7. The device of claim 5 wherein said third, middle layer is an aluminum foil material.

8. The device of claim 5 wherein said front and back panels each further comprise an additional layer overlying said second interior layer said additional layer being impervious to liquids and chemically inert, to etiologic agents and biological materials.

9. The device of claim 8 wherein said additional layer is a material chosen from the group consisting of polyvinyl chlorides, polyesters, polycarbonates, polyethylenes, and paper or cardboard coated with polyvinyl chlorides, polyesters, polycarbonates or polyethylenes.

10. The device of claim 8 wherein the thickness of said additional layer is between about 2 and about 15 mils.

* * * * *